US006303546B1

(12) United States Patent
Hata et al.

(10) Patent No.: US 6,303,546 B1
(45) Date of Patent: Oct. 16, 2001

(54) TRACTION DRIVE FLUID

(75) Inventors: Hitoshi Hata; Tomomi Miyaji, both of Chiba-ken; Nobuo Goto, Kanagawa-ken; Yoshie Arakawa, Kanagawa-ken; Yasuhiro Murakami, Kanagawa-ken, all of (JP)

(73) Assignees: Idemitsu Kosan Co., Ltd.; NSK Co., Ltd., both of Tokyo; Nissan Motor Co., Ltd., Yokohama, all of (JP)

( * ) Notice: Subject to any disclaimer, the term of this patent is extended or adjusted under 35 U.S.C. 154(b) by 0 days.

(21) Appl. No.: 09/585,353

(22) Filed: Jun. 2, 2000

(30) Foreign Application Priority Data

Jun. 4, 1999 (JP) ..... 11-157733

(51) Int. Cl.[7] ..... C10M 141/12

(52) U.S. Cl. ..... 508/192; 508/291; 508/294; 508/431; 508/432; 508/434; 508/436; 508/438; 508/442

(58) Field of Search ..... 508/192, 291, 508/294, 431, 432, 434, 436, 438, 442

(56) References Cited

U.S. PATENT DOCUMENTS 4,428,849 * 1/1984 Wisotsky .
4,634,543 * 1/1987 Okada et al. .
5,064,546 * 11/1991 Dasai .
5,110,488 * 5/1992 Tipton et al. .
5,330,667 7/1994 Tiffani, III et al. .
6,001,780 * 12/1999 Ho et al. .
6,232,275 * 5/2001 Ichihashi et al. .

FOREIGN PATENT DOCUMENTS 0 459 656 12/1991 (EP) .
0 663 436 7/1995 (EP) .
0 699 738 3/1996 (EP) .
0 798 367 10/1997 (EP) .

* cited by examiner

*Primary Examiner*—Jerry D. Johnson
(74) *Attorney, Agent, or Firm*—Oblon, Spivak, McClelland, Maier & Neustadt, P.C.

(57) ABSTRACT

There is disclosed a traction drive fluid which comprises a base oil blended with (A) an active phosphate ester base compound, (B) a boron-containing imide base dispersant (e.g. polyalkenyl succinimide treated with a boron compound) and (C) a boron-free imide base dispersant (e.g. polyalkenyl succinimide) in such blending amounts that the phosphorus content derived from the component (A) and the boron content derived from the component (B) are each 100 to 600 ppm, preferably 60 to 300 ppm by weight, and at least 60 ppm by weight, respectively based on the base oil, and the boron-free imide base dispersant (C) is blended so that the ratio by weight of the nitrogen in the component(C) to the boron in the component (B) is at least 1, preferably 1 to 6. The traction drive fluid has excellent wear resistance and excellent scoring resistance of a steel material element, is capable of suppressing surface damage such as peeling of a friction material and in particular, is well suited for use as a lubricating oil for a traction drive continuous variable transmission used in an automobile.

7 Claims, No Drawings

TRACTION DRIVE FLUID

BACKGROUND OF THE INVENTION

1. Field of the Invention

The present invention relates to a traction drive fluid. More particularly, the present invention is concerned with a traction drive fluid which has excellent wear resistance and excellent scoring resistance, is capable of suppressing surface damage such as peeling of a friction material and in particular, is well suited for use as a lubricating oil for a traction drive continuously variable transmission used in an automobile.

2. Description of the Related Arts

A traction drive fluid is employed in a traction drive apparatus (friction drive apparatus by rolling contact drive), for instance, continuously variable transmissions for an automobile, continuously variable transmissions for industrial use and the like. In particular, a traction drive continuously variable transmission used in an automobile is equipped with a starting/running device and a lock-up clutch. Accordingly, the traction drive fluid employed therein is called upon to have lubricating characteristics for lubricating portions of high surface pressure such as gears, roller-bearings and traction drive portions, for instance, to have lubricity and peel resistant durability for a clutch friction material further to wear resistance and scoring (seizure) resistance therefor.

In recent years, automobile transmissions show a tendency to be miniaturized, light-weighted and maximized in transmission capacity. This is also the case with a traction drive continuously variable transmission. The aforesaid technological tendency accelerates heat generation at lubricating portions and brings about an increase in thermal load for a lubricating oil used therein. As a result, the traction drive fluid used therein is called upon to have heat resistance and besides, a high lubricating performance and adaptability to materials for lubricating portions under the condition of an elevated temperature.

Such being the case, the aforesaid traction drive fluid is required to be imparted with friction characteristics for a friction material (wet clutch) and at the same time, wear resistance and scoring resistance, thus bringing about a trend towards the use of an additive having high reactivity with a metallic surface.

However, an additive having high reactivity with a metallic surface, that is, an active additive is highly active also with cellulose which is a principal component of a friction material. Thus the aforesaid active additive suffers from such disadvantages that accelerate cutoff of cellulose structure (cutoff of cellulose fibers in the form of rings and chains) and elution thereof in oil or the like, and are more prone to cause damage such as peeling to a friction material.

In such circumstances, there has eagerly been desired the development of a traction drive fluid capable of alleviating and suppressing the reaction with cellulose which reaction is responsible for peeling and the like of a friction material, without impairing its wear resistance and scoring resistance of a steel material element.

There has only been reported the working effect of a metal base detergent (calcium sulfonate having a total base number of 300 ) as a technique for alleviating and suppressing the peeling damage to a friction material (refer to preliminary prints for scientific lecture, Japan Automotive Engineering Society, 952, 9535297, 1995-5 ). Nevertheless, in the case of blending the above-mentioned metal base detergent dispersant, there is caused the problem of a fear of clogging the pores on the surface of a friction material, thereby deteriorating the lubricating characteristics and the like.

SUMMARY OF THE INVENTION

Under such circumstances, a general object of the present invention is to provide a traction drive fluid which has excellent wear resistance and excellent scoring resistance, is capable of suppressing surface damage such as peeling of a friction material and in particular, is well suited for use as a lubricating oil for a traction drive continuously variable transmission used in an automobile.

Other objects of the present invention will be obvious from the text of this specification hereinafter disclosed.

In view of the foregoing, intensive extensive research and investigation were accumulated by the present inventors in order to achieve the above-mentioned objects. As a result, it has been found that the objects can effectively be attained by a traction drive fluid which comprises a base oil blended with an active phosphate ester base compound, a boron-containing imide base dispersant and a boron-free imide base dispersant each at a specific proportion based on said base oil. The present invention has been accomplished by the foregoing findings and information.

Specifically, the present invention provides a traction drive fluid which comprises a base oil blended with (A) an active phosphate ester base compound, (B) a boron-containing imide base dispersant and (C) a boron-free imide base dispersant in such blending amounts that the phosphorus content derived from the component (A) and the boron content derived from the component (B) are made to be in the range of 100 to 600 ppm by weight and at least 60 ppm by weight, respectively based on said base oil, and the boron-free imide base dispersant (C) is blended so that the ratio by weight of the nitrogen in the component (C) to the boron in the component (B) (N/B ratio) is made to be at least one (1).

DESCRIPTION OF THE PREFERRED EMBODIMENTS

The base oil in the traction drive fluid according to the present invention is not specifically limited, but may be properly and optionally selected for use from the base oils that have heretofore been customarily used for a traction drive fluid. The above-mentioned base oils are exemplified by mineral oils such as paraffin base mineral oil, naphthene base mineral oil and intermediate base mineral oil, and synthetic oils such as a saturated hydrocarbon compound, an ester compound and an ether compound each having at least one member selected from the group consisting of cyclohexane ring, decalin ring, bicycloheptane ring and bicyclooctane ring. In particular, as the saturated hydrocarbon compound having a cyclohexane ring, there are usable the compounds described in Japanese Patent Application Publication Numbers 80191/1991 (Heisei-3) , 52958/ 1990 (Heisei-2) and 39419/1994 (Heisei-6) and the like; as the saturated hydrocarbon compound having a decalin ring, there are usable the compounds described in Japanese Patent Application Publication Number 43392/1985 (Showa-60) and the like, as the saturated hydrocarbon compound having a bicycloheptane ring, there are usable the compounds described in Japanese Patent Application Publication Numbers 31914/1993 (Heisei-5), 103387/1995 (Heisei-7) and the like; and as the saturated hydrocarbon compound having a bicyclooctane ring, there are usable the compounds described in Japanese Patent Application Laid-Open Number 9134/1993 (Heisei-5) and the like.

In the present invention, the base oil is used usually in an amount of at least 80% by weight based on the traction drive fluid, and may be used alone or in combination with at least one other species.

The active phosphate ester base compound to be used as the component (A) in the traction drive fluid according to the present invention is not specifically limited, but may be properly and optionally selected for use in accordance with the situation from the well known active phosphate ester base compounds that have heretofore been used as an extreme pressure agent or an anti-wear agent, for instance, acidic phosphate esters, phosphite esters, acidic phosphite esters and hypophosphite esters.

As the active phosphate ester base compound to be used in the traction drive fluid according to the present invention, there are preferably used the acidic phosphate esters and phosphite esters represented by the general formula (I):

(I)

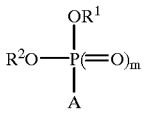

wherein A is hydrogen atom or hydroxyl group, m is 0 or 1 with the proviso that A is hydroxyl group when m is 0, and A is hydrogen atom or hydroxyl group when m is 1, and $R^1$ and $R^2$ are each hydrogen atom or a hydrocarbon group which has 1 to 18 carbon atoms and may contain at least one member selected from the group consisting of sulfur atom.

Examples of the aforesaid hydrocarbon group which has 1 to 18 carbon atoms include a straight chain or branched alkyl group having 1 to 18 carbon atoms; a cycloalkyl group having 3 to 18 carbon atoms; a straight chain or branched alkenyl group having 2 to 18 carbon atoms; an aryl group having 6 to 18 carbon atoms; and an aralkyl group having 7 to 18 carbon atoms. Examples of the alkyl group having 1 to 18 carbon atoms include methyl group, ethyl group, n-propyl group, isopropyl group, n-butyl group, isobutyl group, sec-butyl group, tertbutyl group, pentyl group, hexyl group, octyl group, 2-ethylhexyl group, decyl group, dodecyl group, tetradecyl group, hexadecyl group and octadecyl group. Examples of the cycloalkyl group having 3 to 18 carbon atoms group include cyclopentyl group, cyclohexyl group, methylcyclohexyl group and cyclooctyl group. Examples of alkenyl group having 2 to 18 carbon atoms include allyl group, propenyl group, butenyl group, octenyl group, decenyl group and oleyl group. Examples of aryl group having 6 to 18 carbon atoms include phenyl group, tolyl group, xylyl group and naphthyl group. Examples of aralkyl group having 7 to 18 carbon atoms include benzyl group, phenethyl group and naphthylmethyl group.

In addition, the hydrocarbon group having 1 to 18 carbon atoms may contain at least one oxygen atom and/or at least one sulfur atom. That is to say, the above-mentioned hydrocarbon group may contain at least one ether group, or at least one thioether group, or both said groups in its main chain. Examples of the aforesaid hydrocarbon group include hexyloxymethyl group, hexyloxyethyl group, octyloxymethyl group, octyloxyethyl group, dodecyloxymethyl group, dodecyloxyethyl group, hexadecyloxymethyl group, hexadecyloxyethyl group, hexylthiomethyl group, hexylthioethyl group, octylthiomethyl group, octylthioethyl group, dodecylthiomethyl group, dodecylthioethyl group, hexadecylthiomethyl group and hexadecylthioethyl group.

The $R^1$ and $R^2$ may be the same as or different from each other, but are not simultaneously hydrogen atom.

Examples of the acidic phosphate ester among the compound represented by the general formula (I) include the compound having the structure represented by the general formula (I-a)

(I-a)

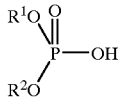

wherein $R^1$ and $R^2$ are each as previously defined.

Examples of the acidic phosphate ester represented by, the, general formula (I-a) include mono- or di-hexylhydrogen phosphate, mono- or di-octylhydrogen phosphate, mono- or di-dodecylhydrogen phosphate, mono- or di-hexadecylhydrogen phosphate, mono- or di-(hexylthioethyl)hydrogen phosphate, mono- or di-(octylthioethyl) hydrogen phosphate, mono- or di-(dodecylthioethyl) hydrogen phosphate, mono- or di-(hexadecylthioethyl)hydrogen phosphate, mono- or di-octenylhydrogen phosphate, mono- or di-oleylhydrogen phosphate, mono- or di-cyclohexylhydrogen phosphate, mono- or di-phenylhydrogen phosphate, mono- or di-toluylhydrogen phosphate, mono- or di-benzylhydrogen phosphate, mono- or di-phenetylhydrogen phosphate and the like.

Examples of the phosphite ester among the compound represented by the general formula (I) include the acidic phosphite ester having the structure represented by the general formula (I-b) or (I-c):

(I-b)

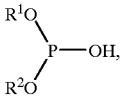

(I-c)

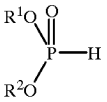

wherein $R^1$ and $R^2$ are each as previously defined.

Examples of the acidic phosphite ester represented by the general formula (I-b) or (I-c) include mono- or di-hexylhydrogen phosphite, mono- or di-octylhydrogen phosphite, mono- or di-dodecylhydrogen phosphite, mono- or di-hexadecylhydrogen phosphite, mono- or di-(hexylthioethyl)hydrogen phosphite, mono- or di-(octylthioethyl)hydrogen phosphite, mono- or di-(dodecylthioethyl)hydrogen phosphite, mono- or di-(hexadecylthioethyl)hydrogen phosphite, mono- or di-octenylhydrogen phosphite, mono- or di-oleylhydrogen phosphite, mono- or di-cyclohexylhydrogen phosphite, mono- or di-phenylhydrogen phosphite, mono- or di-toluylhydrogen phosphite, mono- or di-benzylhydrogen phosphite, mono- or di-phenetylhydrogen phosphite and the like.

In the present invention, the active phosphate ester-based compound as the component (A) may be used alone or in combination with at least one other species.

In the present invention, the boron-containing imide base dispersant as the component (B) is not specifically limited, but may be properly and optionally selected for use from among the additives that have heretofore been customarily, used as additives for lubricating oils.

The foregoing boron-containing imide base dispersant is exemplified by the compound obtained by treating, with a boron compound, a monopolyalkenyl or polyalkyl succinimide represented by the general formula (II):

(II)

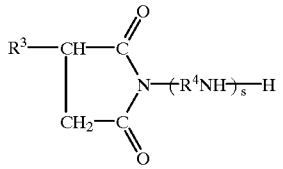

or bispolyalkenyl or polyalkyl succinimide represented by the general formula (III):

(III)

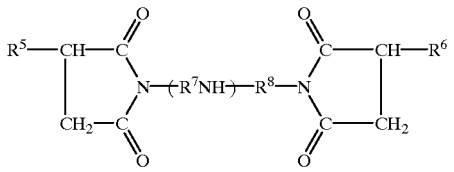

In the general formulae (II) and (III), $R^3$, $R^5$ and $R^6$ are each independently an oligomer residue of an α-olefin having approximately 2 to 8 carbon atoms or a hydrate thereof, $R^5$ and $R^6$ may be the same or different, $R^4$ $R^7$ and $R^8$ are each independently an alkylene group having 2 to 4 carbon atoms, $R^7$ and $R^8$ may be the same or different, s is an integer from 1 to 10, and t is 0 or an integer from 1 to 10.

In the present invention, the boron-containing imide base dispersant as the component (B) may be any of the boron-treated mono-compound represented by the general formula (II), the boron-treated bis-compound represented by the general formula (III) and a mixture of the above two.

Of the aforesaid polyalkenyl or polyalkyl succinimide, there is preferably usable polyalkenyl succinimide, especially polybutenyl succinimide having a weight-average molecular weight of approximately 500 to 3000. Nitrogen and boron contents thereof are not specifically limited.

In the present invention, the boron-free imide base dispersant as the component (C) is not specifically limited, but may be properly and optionally selected for use from among the additives that have heretofore been customarily used as additives for lubricating oils.

Said boron-free imide base dispersant is exemplified by the monopolyalkenyl or polyalkyl succinimide represented by the general formula (II) and the bispolyalkenyl or polyalkyl succinimide represented by the general formula (III).

In the present invention, the boron-free imide base dispersant as the component (C) may be any of the mono-compound represented by the general formula (II), the bis-compound represented by the general formula (III) and a mixture of the above two.

Of the aforesaid polyalkenyl or polyalkyl succinimide, there is preferably usable polyalkenyl succinimide, especially polybutenyl succinimide having a weight-average molecular weight of approximately 500 to 3000. Nitrogen content thereof is not specifically limited.

In the traction drive fluid according to the present invention, it is necessary that each of the components (A), (B) and (C) be blended at a proportion as described hereunder on the basis of the base oil.

In the first place, the active phosphate ester base compound as the component (A) should be blended so that the phosphorus content derived from the component (A) is made to be in the range of 100 to 600 ppm by weight in the traction drive fluid. Said content, when being less than 100 ppm by weight, results in failure to sufficiently exhibit the lubricity, whereas said content, when being more than 600 ppm by weight, brings about an economical disadvantage rather than the working effect on improving the lubricity, since said effect is not in proportion to the blending amount.

Next, the boron-containing imide base dispersant as the component (B) should be blended so that the boron content derived from the component (B) is made to be at least 60 ppm by weight in the traction drive fluid. Said content, when being less than 60 ppm by weight, leads to insufficient working effect on alleviating and suppressing the unfavorable attack by active phosphate ester base compounds and active sulfur base compound against the cellulose base friction material (acceleration of cutoff and dissolution of cellulose chains due to the reaction between the cellulose and the active phosphate ester base compounds and/or the active sulfur base compound). In view of the performance of the traction drive fluid according to the present invention, the component (B) should be blended so that the boron content derived from the component (B) is made to be in the range of preferably 60 to 600 ppm, more preferably 60 to 300 ppm.

In addition, the boron-free imide base dispersant as the component (C) should be blended so that the ratio by weight of the nitrogen in the component (C) to the boron in the component (B) {N/B ratio by weight} is made to be at least one (1). Said N/B ratio by weight, when being less than 1, brings about insufficient working effect on synergistically alleviating and suppressing the unfavorable attack by active phosphate ester base compounds and active sulfur base compound against the cellulose base friction material. On the other hand, said N/B ratio by weight, when being unreasonably high, leads to a fear of causing unfavorable circumstances such as the formation of sludge and unreasonably deep hue of the traction drive fluid. In view of the foregoing, said N/B ratio by weight is made to be in the range of preferably 1 to 10, more preferably 1 to 6.

In the present invention, the above-mentioned component (A) and the component (B) can be blended in the base oil after mixing in advance both the components as desired, and then subjecting the resultant mixture to heating treatment at a temperature in the range of 120 to 150° C. for at least 5 hours. It is acceptable in this case to mix the component (A) in part and the component (B) in part that are to be blended, subject the resultant mixture to heating treatment, and subsequently mix into the base oil, the heated mixture and the remainders of the component (A) and the component (B). Alternatively, it is also acceptable in this case to mix the component (A) in whole and the component (B) in whole that are to be blended, subject the resultant mixture to heating treatment, and subsequently mix the heated mixture into the base oil.

In more detail, the above-mentioned method for heating treatment of both the components comprises the steps of mixing the component (A) and the component (B) at a prescribed ratio, agitating the resultant mixture at a temperature in the range of approximately 40 to 70° C. for approximately 10 minutes to 3 hours to carry out homogenization treatment, and subsequently subjecting the resultant homogenizedly treated mixture to heating treatment at a temperature in the range of 120 to 150° C. for at least 5 hours, preferably for 5 to 24 hours, wherein said heating treatment may be put into practice under standing still or under stirring.

The traction drive fluid according to the present invention may be properly and optionally incorporated at need with any of other well known additives, which are exemplified by antioxidants of phenol base, amine base and zinc dithiophosphate base; detergents/dispersants of imide base, ester base, benzylamine base, phenate base and salicylate base; friction modifying agents of amide base, ester base and fatty acid base; extreme pressure agents and anti-wear agents of phosphorus base and sulfur base; rust preventive agents of metal sulfonate base, succinate ester base and sorbitan ester base; metal deactivators of benzotriazole base and thiadiazole base; and defoaming agents of silicone base; and the like.

The traction drive fluid according to the present invention is imparted with excellent wear resistance and excellent scoring resistance of a steel material element, is capable of suppressing surface damage such as peeling of a friction material and in particular, is well suited for use as a lubricating oil for a traction drive continuous variable transmission used in an automobile.

In the following, the present invention will be described in further detail with reference to comparative examples and working examples, which however shall never limit the present invention thereto.

The performances of the traction drive fluid according to the present invention were evaluated in accordance with the procedures as described hereunder.

(1) seizure resistance characteristics by means of FZG gear test:

In accordance with ASTM D5182-91, FZG gear test was carried out under the conditions of 90° C. , 1450 rpm and 15 minutes, and the seizure resistance characteristics were represented by the stage of scuffing generation load (failure load).

(2) filter paper immersion test.

① Weight Loss of Filter Paper

Filter paper immersion test was carried out by placing 375 ml of a sample oil in a 100 ml wide mouthed vessel, immersing two sheets of #51B filter paper manufactured by ADVANTEC Co. Ltd. (measuring 20×80 mm, made of pure cellulose) in the sample oil, covering the vessel with a lid made of aluminum foil, and heating the vessel in a thermostat (air bath ) at 200° C. for 40 hours under standing still condition.

The filter paper was weighed before and after the test, and the weight loss of the filter paper was calculated by the following formula, in which the more the weight loss thereof, the severer the attack to the cellulose as the filter paper material.

$$\text{weight loss (\%)}=\{(\text{weight before test}-\text{weight after test})/\text{weight before test}\}\times 100$$

② Appearance of Vessel

After the above-mentioned ① filter paper immersion test, observations were made of the states of the vessel in contact with the vapor phase and liquid phase, respectively, and the existence of sediment in the bottom portion of the vessel. Thus evaluations were made of the heat resistance of the sample oil in accordance with the following criteria:

Good; no observation was made of matters stuck to the vessel nor sediment in the bottom portion of the vessel Much stuck; large amounts of matters stuck to the vessel in contact with both the vapor phase and liquid phase Sediment; sediment was observed in the bottom portion of the vessel In the following, some description will be given of the additive (A), additive (B) and additive (C) that were used in the above-mentioned tests.

Additive (A); di(octylthioethyl) hydrogenphosphate having a P content of 8.5% by weight, an S content of 11.6% by weight and a total acid number of 138 mg KOH/g Additive (B); boronated polybutenyl succinimide (manufactured by Exxon Chemical Co., Ltd. under the trade name "ECA 5025") having a B content of 0.35% by weight, an N content of 1.35% by weight, a total acid number of 6.5 mg KOH/g and a base number of 32.5 mg KOH/g Additive (C); polybutenyl succinimide (manufactured by Lubrizol Co., Ltd. under the trade name "Lz6406") having an N content of 1.76% by weight, a total acid number of 1.5 mg KOH/g and a base number of 46.8 mg KOH/g EXAMPLE 1 to 6

Comparative Examples 1 to 7

Various traction drive fluids were each prepared by blending at least one of the additives (A), (B) and (C) the blending amounts of which are shown in Table 1 with a base oil comprising 1,3-dicyclohexyl-1, 1, 3-trimethylpropane having kinematic viscosity of 20.4 $mm^2$ /sec at 40° C. and 3.62 $mm^2$/sec at 100° C., and further blending therewith, 0.5% by weight of 4, 4'-methylenebis(2, 6-di-tert-butylphenol) {manufactured by Ethyl Japan Co., Ltd.}, 0.5% by weight of 4, 4'-dioctylphenylamine {manufactured by Kawaguchi Chemical Co., Ltd.}, 0.3% by weight of oleic acid monoglyceride {manufactured by Kao Corporation}, 0.02% by weight of 1, 2, 3-benzotriazole {manufactured by Johoku Chemical Co., Ltd.} and 0.002% by weight of polydimethylsiloxane {manufactured by Shin-Etsu Chemical Co., Ltd.} each based on the whole amount of the traction drive fluid in question. Thus, the above-described tests were carried out, and evaluations were made of the performances of each of the traction drive fluids thus prepared. The results are given in Table 1.

In addition, an automatic transmission oil (AFT) available on the market (manufactured by Idemitsu Kosan Co. Ltd. under the trade name "Ap AFT D3") was subjected to the filter paper immersion test in the same manner as the foregoing. As a result, the weight loss of the filter paper was 23.7% , and the appearance of vessel was "good".

TABLE 1

| | Additives | | | | Seizure | Filter paper immersion test | |
|---|---|---|---|---|---|---|---|
| | (A) P content (wt. ppm) | (B) B content (wt. ppm) | (C) N content (wt. ppm) | N/B (wt. ratio) | resistance characteristics by FZG test X·1 | wt. loss of filter paper (wt. %) | vessel appearance |
| Ex.-1 | 300 | 100 | 105 | 1.05 | 11 | 18.6 | good |
| Ex .-2 | 300 | 100 | 175 | 1.75 | — | 13.4 | good |

TABLE 1-continued

| | Additives | | | | Seizure | Filter paper immersion test | |
|---|---|---|---|---|---|---|---|
| | (A) P content (wt. ppm) | (B) B content (wt. ppm) | (C) N content (wt. ppm) | N/B (wt. ratio) | resistance characteristics by FZG test ·X·1 | wt. loss of filter paper (wt. %) | vessel appearance |
| Ex. -3 | 600 | 100 | 175 | 1.75 | — | 24.5 | good |
| Ex. -4 | 300 | 60 | 105 | 1.75 | — | 22.1 | good |
| Ex. -5 | 300 | 100 | 350 | 3.50 | 10 | 9.4 | good |
| Ex. -6 | 150 | 60 | 105 | 1.75 | 11 | 7.3 | good |
| CEx-1 | 300 | — | — | — | 11 | 56.2 | sedi't |
| CEx-2 | 600 | — | — | — | — | 67.4 | sedi't |
| CEx-3 | 300 | 100 | — | — | — | 31.4 | good |
| CEx-4 | 600 | 100 | — | — | — | 40.3 | good |
| CEx-5 | 300 | — | 350 | — | — | 46.4 | much stuck |
| CEx-6 | 300 | 100 | 60 | 0.60 | — | 28.7 | good |
| CEx-7 | 300 | 40 | 105 | 2.63 | — | 36.0 | good |

{Remarks}
Ex: Example, CEx: Comparative Example, P content: phosphorus content derived from additive (A) in fluid, B content: boron content derived from additive (B) in fluid, N content: nitrogen content derived from additive (C) in fluid, N/B: weight ratio of nitrogen content derived from additive (C) to boron content derived from additive (B), sedi't: sediment, ·X·1: expressed by the stage of scuffing generation load

What is claimed is:

1. A traction drive fluid which comprises a base oil blended with (A) an active phosphate ester base compound, (B) a boron-containing imide base dispersant and (C) a boron-free imide base dispersant in such blending amounts that the phosphorus content derived from the component (A) and the boron content derived from the component (B) are made to be in the range of 100 to 600 ppm by weight and at least 60 ppm by weight, respectively based on said base oil, and the boron-free imide base dispersant (C) is blended so that the ratio by weight of the nitrogen in the component (C) to the boron in the component (B) is made to be at least one (1).

2. The traction drive fluid according to claim 1, wherein the boron content derived from the component (B) is in the range of 60 to 300 ppm by weight.

3. The traction drive fluid according to claim 1, wherein the ratio by weight of the nitrogen in the component (C) to the boron in the component (B) is in the range of 1 to 6.

4. The traction drive fluid according to claim 1, wherein the base oil is blended with the components (A) and (B) that have been subjected to heating treatment at 120 to 150° C. for at least 5 hours, and further with the component (C).

5. The traction drive fluid according to claim 1, wherein the active phosphate ester base compound is at least one member selected from the group consisting of the acidic phosphate esters and phosphite esters represented by the general formula (I):

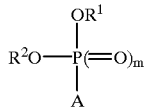

(I)

wherein A is hydrogen atom or hydroxyl group; m is 0 or 1 with the proviso that A is hydroxyl group when m is 0, and A is hydrogen atom or hydroxyl group when m is 1; and $R^1$ and $R^2$ are each hydrogen atom or a hydrocarbon group which has 1 to 18 carbon atoms, and which may contain at least one member selected from the group consisting of oxygen atom and sulfur atom with the provisos that $R^1$ and $R^2$may be the same as or different from each other, but are not simultaneously hydrogen atom.

6. The traction drive fluid according to claim 1, wherein the boron-containing imide base dispersant as the component (B) is polyalkenyl succinimide which has been treated with a boron compound.

7. The traction drive fluid-according to claim 1, wherein the boron-free imide base dispersant as the component (C) is polyalkenyl succinimide.

* * * * *